United States Patent [19]

El-Souessi et al.

[11] 4,129,188

[45] Dec. 12, 1978

[54] IMPACT DEVICE FOR MARKING, PUNCHING, STAMPING, FORMING, RIVETING AND OTHER RELATED OPERATIONS

[76] Inventors: Monti El-Souéssi, 632 Stoops Ferry Rd., Coraopolis, Pa. 15108; Gilbert Laffay, II Rue des Glycines, Meyzieu, Rhone, France; Jean-Christian Neuschwander, 34 Rue de la Claire, Lyon 9éme, Rhone, France

[21] Appl. No.: 775,382

[22] Filed: Mar. 7, 1977

[30] Foreign Application Priority Data

Mar. 10, 1976 [FR] France ..... 76 07589

[51] Int. Cl.[2] ..... B25D 9/00

[52] U.S. Cl. ..... 173/120

[58] Field of Search ..... 173/13, 119, 120, 121; 24/21 R, 21 N

[56] References Cited

U.S. PATENT DOCUMENTS

| | | | |
|---|---|---|---|
| 2,438,777 | 3/1948 | Dean | 173/119 |
| 2,455,270 | 11/1948 | Ravella | 173/120 |

FOREIGN PATENT DOCUMENTS

| | | | |
|---|---|---|---|
| 592462 | 9/1947 | United Kingdom | 173/121 |
| 920195 | 3/1963 | United Kingdom | 173/119 |
| 466098 | 7/1975 | U.S.S.R. | 173/119 |

*Primary Examiner*—Robert A. Haffer

*Attorney, Agent, or Firm*—Edward L. Levine

[57] ABSTRACT

An impact device for use in machines, such as presses, for marking, punching, stamping, forming, riveting, and other related operations, wherein a convex edged member, such as a ball, axially separates a tool and a hammer, the hammer being loaded by compressible means such as a tension spring, all moveable axially within a moveable spindle. The ball is displaced radially into an adjoining magazine at the point of full extension of the spindle, after the tool is in contact with the workpiece, thereby allowing the spring loaded hammer to strike the tool, imparting an impact force to the workpiece.

8 Claims, 4 Drawing Figures

IMPACT DEVICE FOR MARKING, PUNCHING, STAMPING, FORMING, RIVETING AND OTHER RELATED OPERATIONS

BACKGROUND OF THE INVENTION

1. FIELD OF THE INVENTION

This invention relates to impact devices, and more particularly to an impact device for use in machines such as presses utilized in marking, punching, stamping, forming, riveting and other related operations.

2. DESCRIPTION OF THE PRIOR ART

To accomplish marking, punching, stamping, forming, riveting and other related operations, it is customary to economize on the use of energy and size of equipment required by storing a given quantity of energy through elastic means, such as a compressed spring, and subsequently releasing the elastic means to impart the necessary force to a workpiece.

Machines of this type have included a tubular shaped spindle in which a hammer and tool are axially movable. The hammer is displaced relative to the spindle thereby compressing a tension spring which at a given moment is allowed to expand and drive the hammer onto the head of the tool.

There are various manners in which the spring expansion can be achieved. For example, in French Pat. No. 1161913, the structure consists of a circumferential groove in the hammer into which a plurality of balls are placed. An enlarged section of the spindle is constructed which will allow these balls to move radially, thereby freeing the hammer. A socket is interposed circumferentially between the hammer and spindle, encircling the hammer and holding the balls within the hammer groove. The relative displacement of the hammer and spindle is achieved through the socket pressing on the balls within the hammer groove. When the hammer groove is in line with the enlarged section within the spindle, they are forced out of the hammer groove, thereby releasing the hammer to strike the tool, releasing the energy in the compressed spring. There are also other springs coaxial with the hammer and socket to allow return of the balls to the hammer groove after impact.

Although such devices have been extensively used, they are not without deficiencies. Because of the relatively large number of components, the devices are complex and difficult to assemble. Further, the force must be transmitted through a series of components, thereby limiting the ultimate impact force. And, the large number of components results in a relatively expensive device.

SUMMARY OF THE INVENTION

This invention provides a device which is relatively simple and alleviates many of the above deficiencies, while providing additional abilities.

The invention provides an impact device for use in machines, such as presses, for marking, punching, stamping, forming, riveting, assembling, and other related operations, wherein a convex edged member, such as a ball, separates a tool and a hammer, the hammer being loaded by compressible means, such as a tension spring, both of which are movable axially within an elongated hollow spindle. As rectilinear motion is applied to one end of the spindle, as by a pneumatically driven piston, the spindle is extended until the tool, at the opposite end of the spindle, contacts a workpiece.

As the spindle continues its downward movement, the spring loading the hammer is compressed, and restraining structure, such as a pin extending radially inward from the inner surface of the spindle, contacts the ball which separates the hammer and tool, to eject the ball into a receptacle having an elastically loaded piston. With the ball removed, the hammer is now driven onto the tool by the compressed spring, thereby imparting an impact force through the tool to the workpiece. As the spindle is retracted, the ball is replaced by the piston into position between the axially separated hammer and tool, thereby preparing the device for further operation.

DESCRIPTION OF THE DRAWINGS

The advantages, nature, and additional features of the invention, will be better understood from the following description taken in connection with the accompanying drawings in which.

DESCRIPTION OF THE PREFERRED EMBODIMENTS

Figure 1:
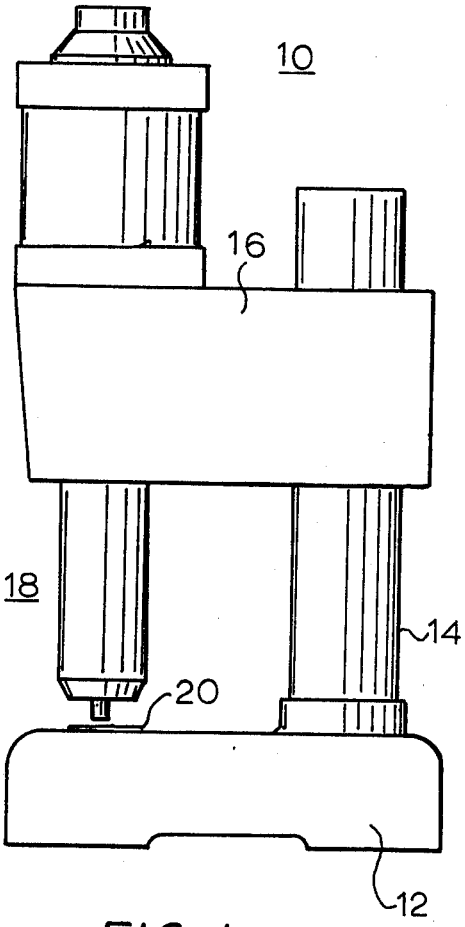
FIG. 1 is a simplified schematic, in elevation, of a press to which this invention can be applied.

Referring now to the drawings, wherein like reference characters denote corresponding parts throughout the several views, and more particularly to FIG. 1, a press 10 is shown including a horizontally extending base 12 to which is connected an upward extending support column 14. To the column 14 is moveably affixed a head structure 16 that houses and locates an impact device 18 above a workpiece 20, located and supported by the base.

Figure 2:
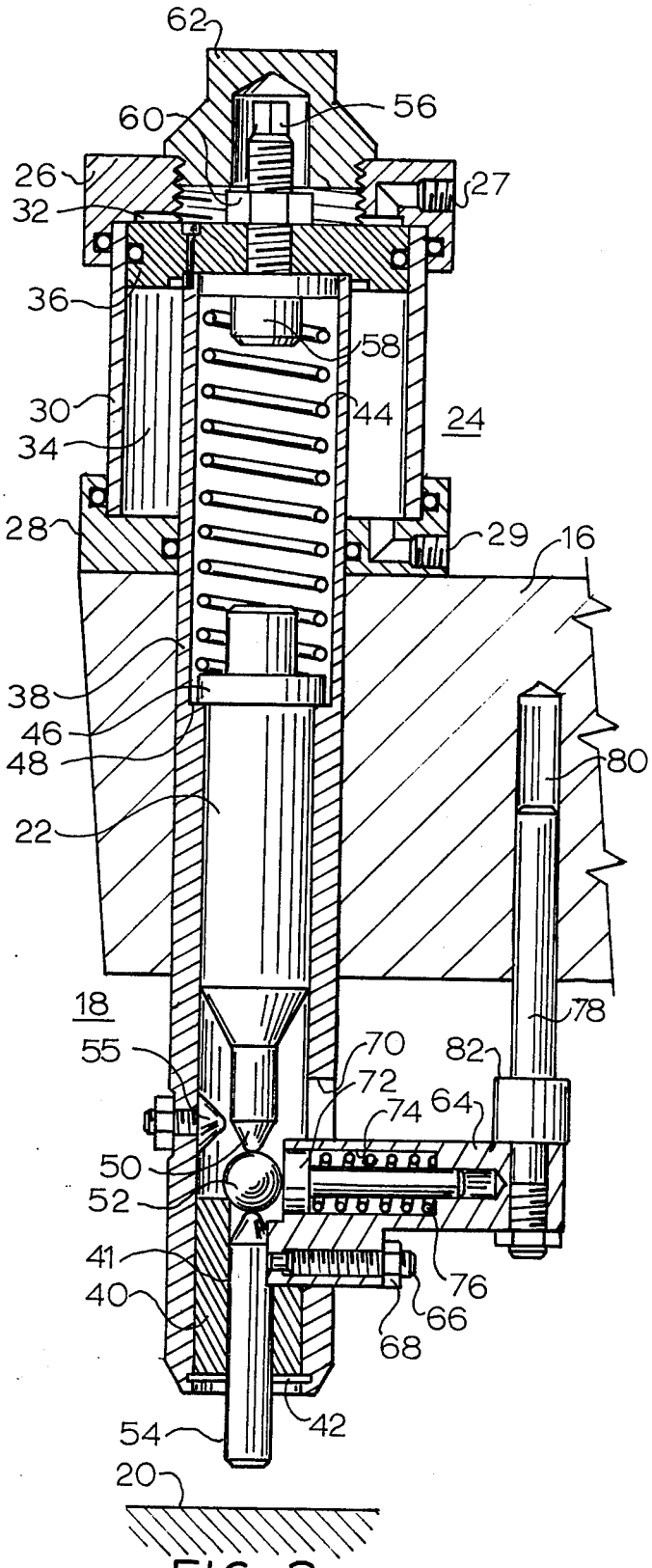
FIG. 2 is a transverse view, in section, indicating an embodiment of the impact device before loading of the hammer.

Referring now to FIG. 2, wherein the operation of the impact device 18 is illustrated prior to loading of a hammer 22, a power cylinder 24 is mounted atop the head 16. The power cylinder is only one of numerous devices well known in the art in impart rectilinear motion to the impact device.

The power cylinder 24 is comprised of an upper cylinder head 26 containing a fluid passage 27 and a lower head 28 containing a fluid passage 29, both of which heads are sealingly connected to opposite ends of power cylinder wall 30.

The power cylinder 24 is divided into two chambers, upper cylinder chamber 32 and lower cylinder chamber 34, respectively above and below a piston 36 axially moveable within the power piston wall 30 and forming a seal there between.

A hollow elongated spindle 38 is attached at one end to piston 36, extends through head 16, and contains a tool holder 40 slideably mounted within its opposite end. The tool holder has an aperture 41 for receiving a tool 54 and is restrained by retaining ring 42. Hammer 22 is moveable axially within the spindle 38. A compressible energy storing means, such as a hammer spring 44 is interposed between the hammer 22 and piston 36, bearing on the hammer at a collar 46. The collar bears on a shoulder 48 at the inner wall of spindle 38, so as to limit axial movement of hammer 22. At the end of the hammer opposite to the collar, a convex shaped end 50 is provided to contact a convex edged member, such as a ball 52 normally interposed between, and axially aligned with the end 50 of the hammer and the tool 54 mounted within tool holder 40. Other geometric configurations, in addition to a ball, may also be used. Means are provided to displace ball 52, such as an adjustable ejection pin 55, preferably having a convex tip, extending radially inward into spindle 38 from the wall thereof.

An adjusting screw 56 extends through piston 36 bearing upon piston collar 58 which locates and restrains the piston end of hammer spring 44. A lock nut 60, on adjusting screw 56, accessible through upper cylinder head 26, prevents movement of the adjusting screw, which sets tension in hammer spring 44. A cap member 62, enclosing the adjusting screw and lock nut, is affixed to upper cylinder head 26 so as to form a fluid tight seal.

A receptacle, such as a magazine 64, is attached to tool holder 40 by means such as a set screw 66 and lock nut 68. The magazine extends outward from the tool holder, preferably substantially perpendicular to the axis of the spindle, through an elongated opening 70 in the wall of the spindle 38. The magazine includes means for receiving and discharging the ball 52, such as a sliding piston 72 contained within a piston cylinder 74. The sliding piston is restrained in its movement by elastic means such as a piston spring 76. A guide pin 78, extending upward from the magazine 64, it fitted into pin opening 80 within head 16, to prevent rotation of the tool holder and the magazine. Guide pin 78 has a spacer 82 to limit the axial motion of the magazine and tool holder.

Figure 3:
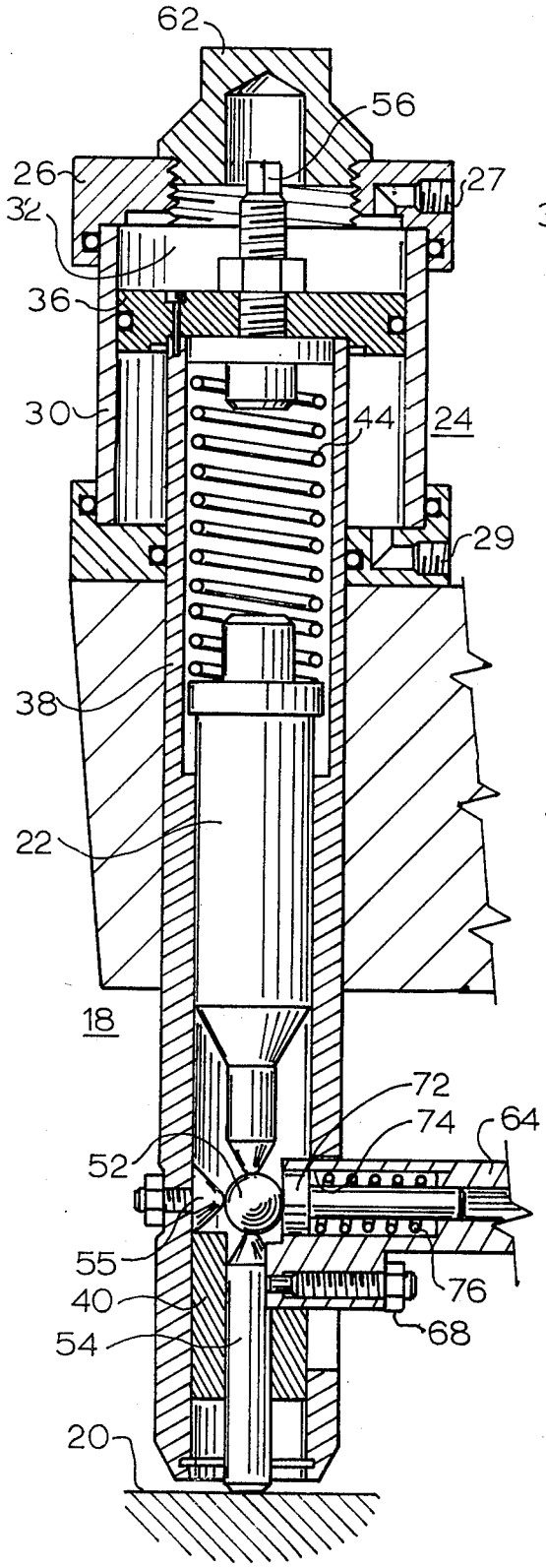
FIG. 3 is another transverse view in section similar to FIG. 2, showing the hammer being loaded.
Figure 4:
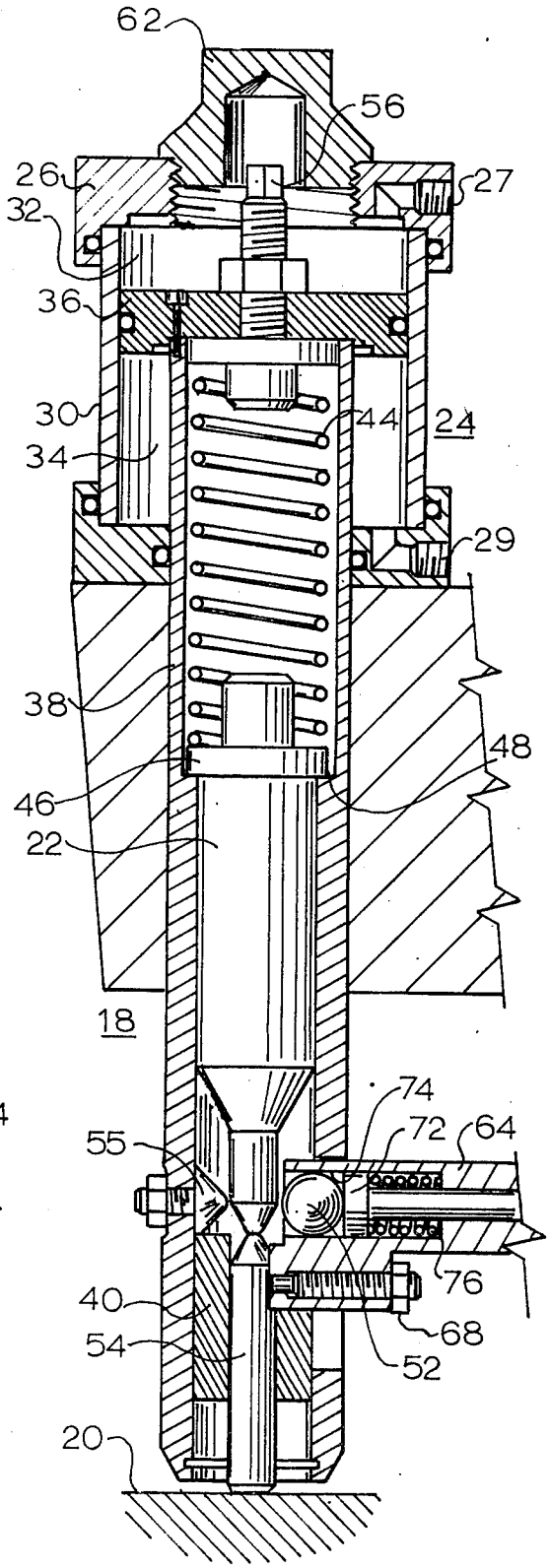
FIG. 4 is yet another transverse sectional view, after displacement of the hammer occurs.

The manner in which the disclosed impact device is used and operate is briefly described as follows. Referring first to FIGS. 2 and 3, a pressurized fluid, such as air, enters the upper cylinder head 26 through fluid passage 27 into upper cylinder chamber 32, forcing the piston 36 and attached spindle 38 toward workpiece 20. As the workpiece is contacted by the tool 54 attached to tool holder 40, the axial movement of the tool holder, ball and hammer is stopped, while the piston and spindle continue their downward travel toward the position shown in FIG. 3. The spindle 38 and piston 36 moving relative to the hammer, ball and tool holder, compress hammer spring 44, while bringing ball 52 into contact with ejection pin 55. As the open end of piston cylinder 74 is aligned with spherical member 52 and ejection pin 55, the ball is ejected toward the cylinder by the contact force of the hammer and tool. The ball then displaces the piston 72, compressing spring 76. This sudden displacement of ball 52 allows hammer spring 44 to extend, driving hammer 22 onto tool 54, thereby imparting an impact force through the tool to workpiece 20 as illustrated in FIG. 4.

Subsequent to impact, by means well known in the art such as inletting fluid into lower chamber 34 and outletting fluid from upper chamber 32, piston 36 is reversed, forcing the piston and spindle 38 away from workpiece 20, thereby withdrawing hammer 22 by the abutment of collar 46 resting on shoulder 48 within spindle, As the spindle is withdrawn from the workpiece, ejection pin 55 is withdrawn from alignment with piston cylinder 74 of magazine 64, allowing piston spring 76 to extend and displace sliding piston 72, thereby replacing ball 52 between hammer and tool to allow another operating cycle to begin.

There has therefore been described an impact device significantly simplified as compared to the prior art. It will also be noted that the impact device can be positioned quite close to the workpiece, thereby adding a significant safety feature regarding hand manipulation of the workpiece.

While the invention has been described through specific exemplary embodiments, it will be apparent that many modifications and additions are possible in view of the above teachings. For example, multiple impact devices can be closely spaced on a single support structure. Also, the impact force can be varied over a substantial range by varying the size of the ball and the magnitude of the driving spring constant. Similarly, the speed of operation can be varied by controlling the force applied to move the spindle. Additionally, the driving force can be automatically or manually applied, particularly for a hand held impact device which can be used in a horizontal or or any other orientation. Components can also be joined or shaped in various manners, such as combining the tool and tool holder. Additional features can also be applied. It therefore is to be understood that within the scope of the appended claims, the invention may be practiced other than as specifically described.

We claim:

1. An impact device having a hollow walled elongated spindle, said spindle having an opening through said wall, and a hammer and tool each having longitudinal axes aligned with one another disposed for sliding movement within said spindle upon a force applied by a compressible member and axial motion of said spindle, comprising:

a. a spherical member positionable between the ends of said hammer and tool along said aligned axes and ejectable from said position upon pressure applied to said member by said hammer and tool; and b. a receptable disposed through said opening in said spindle wall, moveable with respect to said spindle, having means for receiving and subsequently discharging said spherical member upon said ejectment of said spherical member.

2. The device of claim 1 further comprising structure positioned within said spindle for restraining said spherical member from motion other than substantially parallel to said aligned axes upon non-alignment of said spherical member and said structure and from additional motion other than into and out of said receiving and discharging means.

3. The device of claim 1 wherein said discharge and receiving means comprise a piston disposed within a cylinder, said cylinder having an open end within said spindle sized to receive said spherical member, said piston being held adjacent said open end by elastic means which compress upon said ejectment of said spherical member so as to allow said spherical member to enter said cylinder.

4. An impact device having a hollow walled elongated spindle, said spindle having an opening through said wall, and a hammer and tool each having longitudinal axes aligned with one another disposed for sliding movement within said spindle upon a force applied by a compressible member and axial motion of said spindle, comprising:

a. a spherical member positionable between the ends of said hammer and tool along said aligned axes and ejectable from said position upon pressure applied to said member by said hammer and tool;

b. a receptable disposed through said opening in said spindle wall, moveable with respect to said spindle, having means for receiving and subsequently discharging said spherical member upon said ejectment of said spherical member, and c. structure positioned within said spindle for restraining said spherical member from motion other than substantially parallel to said aligned axes upon non-alignment of said spherical member and said structure and from additional motion other than into and out of said receiving and discharging means, said structure including a body having a convex tip mounted within said wall of said spindle, said body being positionable directly opposite said discharge and receiving means upon said spherical member being positioned for said motion substantially perpendicular to said axis into and out of said discharge and receiving means.

5. A press including a support structure and an impact device for applying a force to a tool comprising:

a. a hollow elongated walled spindle positioned for reciprocating rectilinear movement with respect to said support structure, said spindle having a longitudinal axis and an opening through said wall;

b. a hammer slidably disposed within said spindle for limited reciprocating motion parallel to said longitudinal axis of said spindle;

c. means for applying a force to, and rectilinearly moving, said spindle;

d. elastic means for storing and discharging energy upon relative motion of said hammer and spindle;

e. structure for slideably positioning at least a portion of said tool within said spindle in longitudinal alignment with said hammer parallel to said axis;

f. a spherical member positionable between said aligned hammer and tool along the line of alignment ejectable from said position substantially perpendicular to said axis upon application of pressure by said hammer and tool; and g. a magazine positioned through said opening, moveable with respect to said spindle in a direction parallel to said longitudinal axis of said spindle, said magazine having means substantially perpendicular to said axis for receiving and subsequently discharging said spherical member upon said ejectment.

6. The press of claim 5 wherein said discharge and receiving means comprise a piston disposed within a cylinder, said cylinder having an open end within said spindle sized to receive said spherical member, said piston being held against said open end by elastic means which compress upon said ejectment.

7. The press of claim 5 wherein said structure for positioning said tool within said spindle comprises a tool holder slideably disposed within said spindle having an aperture there through parallel to said longitudinal axis of said spindle for receiving said tool and wherein said magazine includes means for rigidly retaining said tool within said aperture.

8. An impact device comprising:

a. a hollow walled elongated spindle, said spindle including an opening in said wall;

b. an elongated hammer disposed for sliding longitudinal movement within said spindle, said hammer having a convex tip;

c. an elongated tool disposed for sliding longitudinal movement within said spindle, said tool having a convex tip aligned with said tip of said hammer;

d. a spherical member positionable between and in contact with said convex tip of said hammer and said convex tip of said tool, said spherical member being ejectable from said position between and in contact with said tips upon pressure being applied to said member by said hammer and tool;

e. a receptable disposed through said opening in said spindle wall having means for receiving said spherical member upon said ejectment and for discharging said spherical member back to said position between said convex tips; and f. a pin member having a convex tip mounted within said wall of said spindle, said convex tip of said pin member, the center of said spherical member and said receiving and discharge means being aligned upon said spherical member being positioned for said ejectment from said position between said tips of said hammer and tool.

* * * * *